US005582552A

United States Patent [19]

Hofmeister

[11] Patent Number: 5,582,552

[45] Date of Patent: Dec. 10, 1996

[54] TRAINING AID FOR GOLFER

[75] Inventor: James E. Hofmeister, Bothell, Wash.

[73] Assignee: Henry-Griffitts, Inc., Hayden Lake, Id.

[21] Appl. No.: 539,318

[22] Filed: Oct. 4, 1995

[51] Int. Cl.[6] ..... A63B 69/36

[52] U.S. Cl. ..... 473/242; 473/325

[58] Field of Search ..... 273/168; 473/226, 473/238, 242, 325

[56] References Cited

U.S. PATENT DOCUMENTS 2,962,286 11/1960 Brouwer ..... 273/168 X

OTHER PUBLICATIONS

The Slazenger Professional Club Fitting System–The Ultimate System for Precision Fitted golf Equipment, p. 62, publication date unknown.

Henry–Griffitts Golf Club Fitting Manual, by Randy Henry and Jim Griffitts, Aug. 1994, p. 9.

*Primary Examiner*—George J. Marlo

*Attorney, Agent, or Firm*—Wells, St. John, Roberts, Gregory & Matkin, P.S.

[57] ABSTRACT

A golf ball flight angle demonstration device includes a rigid body including integral first and second simulated golf club heads with bottom sole surfaces extending between heel and toe ends. A first club face is located on the first simulated golf club head on a plane set at a first loft angle. A second club face is provided on the second simulated golf club head on a plane set at a second loft angle that is greater than the first loft angle. The club faces are oriented in relation to one another such that the planes of the first and second faces intersect along a reference line substantially parallel to a line tangent either of the sole surfaces at a reference face centerline extending through either club face.

11 Claims, 4 Drawing Sheets

21
10
11
16
17
15
A
12
18
14
13

11
16
14
10
17
15
B
19
18
12
13

14
11
17
10
15
20
16
C
12
13
18

TRAINING AID FOR GOLFER

TECHNICAL FIELD

The present invention relates golf club fitting, and more particularly to an aid used to demonstrate ball flight path angles resulting from club head lie angle variations.

BACKGROUND OF THE INVENTION

Determination of proper lie angles for fitting golf clubs is an important, painstaking process, and one that golfers do not often fully appreciate. There is no known way to mechanize club fitting, especially the determination of the lie angle for a given golfer.

One of the more important aspects considered in properly fitting a golfer with clubs is establishing a consistent lie angle for the clubs. The lie angle is the angle between the club shaft centerline and a line tangent to the sole of the club head at the face centerline. It is important for a golfer to have clubs with consistent lie angles, from drivers to wedges.

The reason consistent lie angles are important is that the ball when struck with the club head positioned at the proper lie angle will fly along a straight path, substantially perpendicular to the club face. A club head swung by a right handed golfer and that is tipped with the toe down is considered to be "flat". A ball struck with the club head in this orientation will typically fly to the right of the target. Conversely, a club head tipped with the heel down is considered to be too upright and the ball will fly to the left of the target.

It is of interest to the fitting professional to make the golfer being fitted aware of the importance in obtaining proper lie angles for the clubs being fitted, so there will be consistency and no need for the golfer to compensate from one club to another.

Given a consistent swing and varying only the lie angle, it has been shown that a four iron will produce a ball flight angle that will leave the ball 7 feet to one side of a target at 100 yards, if the club head is merely four degrees flat or too upright. It is surprising to many golfers that the ball flight angle will increase with the loft of the club being used. So a 9 iron hit with the club head four degrees flat or too upright will result in the ball landing 22 feet to either side of the target at 100 yards. This is a difficult concept to grasp, due to the compound angles of the club faces.

A need has therefor existed for an instructional device that will demonstrate the differences in ball flight angle resulting from improper lie angles, and the exaggeration of the ball flight angle with increasing club face loft.

In the past, an elongated rod with a magnet at one end has been used for attachment to club faces. The magnet includes a flat surface perpendicular to the rod so, when attached to a club face, the rod will indicate the ball flight angle. While this works well with individual clubs, there still remains a need to visually demonstrate the difference improper lie angles make with clubs of differing lofts.

The present lie angle demonstration device fills this need by combining a low loft and a high loft club face in a single unit that, when tipped flat or too upright, will allow direct comparison of probable resulting ball flight angles.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. patent laws "to promote the progress of science and useful arts" (Article 1, Section 8).

In order to better understand the nature of the present invention, reference will first be made to FIGS. 1–3 and 6 of the drawings which diagrammatically show a standard golf club head (FIGS. 1–3) and ball flight angles (FIG. 6) resulting from different lie angles and club loft.

All discussion following assumes the use of right handed clubs, and ball flight angles resulting from a right hand swing. Left hand clubs and corresponding ball flight angles will be opposite to those shown and discussed below.

Figure 1:
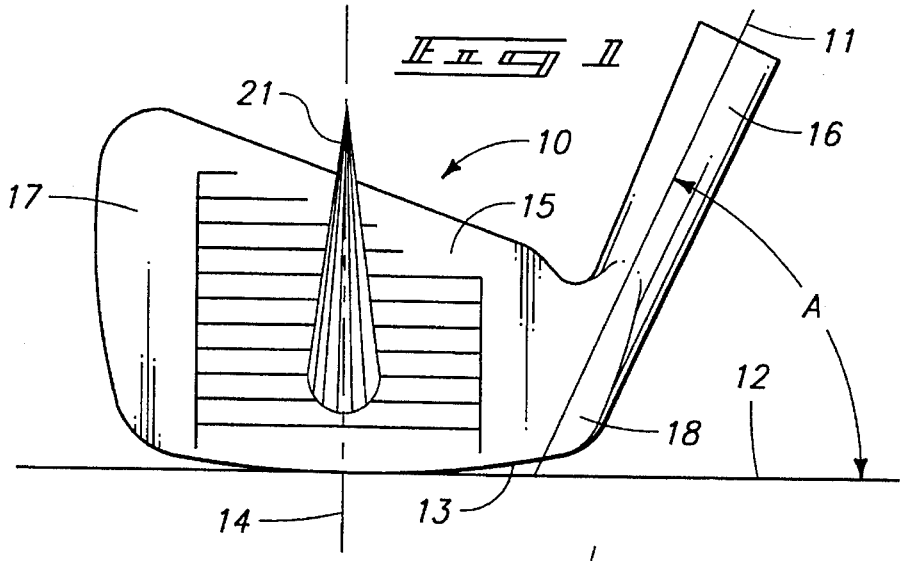
FIG. 1 is a diagrammatic view of a conventional prior art golf club head, used to demonstrate lie angle and with a cone positioned on the club face and pointed in a straight ahead direction indicating a proper ball flight angle.

Referring to FIG. 1, a conventional club head 10 is shown, resting at a proper lie angle A. The lie angle A is shown to be the angle of the shaft axis 11 to a line 12 that is tangent to the club sole 13 at the reference centerline 14 of the club face 15. The centerline 14 is an imaginary vertical line substantially centered on the arc of the sole 13 along a plane perpendicular to the club face 15.

For purposes of this disclosure and appended claims, the "tangent" line 12 for a flat soled club (not shown) would be a line in the plane of the flat sole, perpendicular to the club face centerline.

It is important for a balanced swing to have the lie angles consistent for all clubs in a golfer's inventory, so the golfer's swing may be kept consistent regardless of the club being used. To do this the teaching professional will make various adjustments to the clubs after evaluating the golfer's physical characteristics and swing.

It is important for the golfer to properly understand the importance of a proper actual lie angle. The actual lie angle as used in this disclosure is the orientation of the fixed "true"

lie angle at the impact point in a swing. Thus the actual lie angle may vary significantly from club to club and from golfer to golfer. The goal, though, should be to fit a golfer with clubs that, given a balanced, consistent swing, the actual lie angle will closely approximate the true lie angle for every club in the set. The present demonstration device 20 is intended to show the golfer why close attention should be given the various procedures performed by the teaching professional in properly fitting the golfer with the correct clubs.

Figure 2:
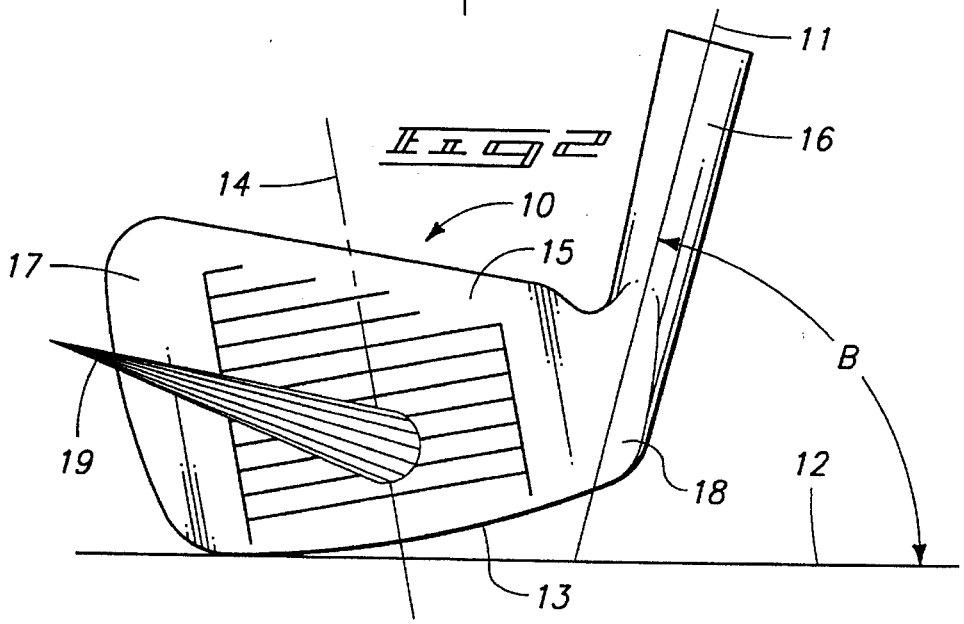
FIG. 2 is a diagrammatic view similar to FIG. 1 only showing the club head tipped too flat and a cone on the club face indicating the resulting ball flight angle.
Figure 3:
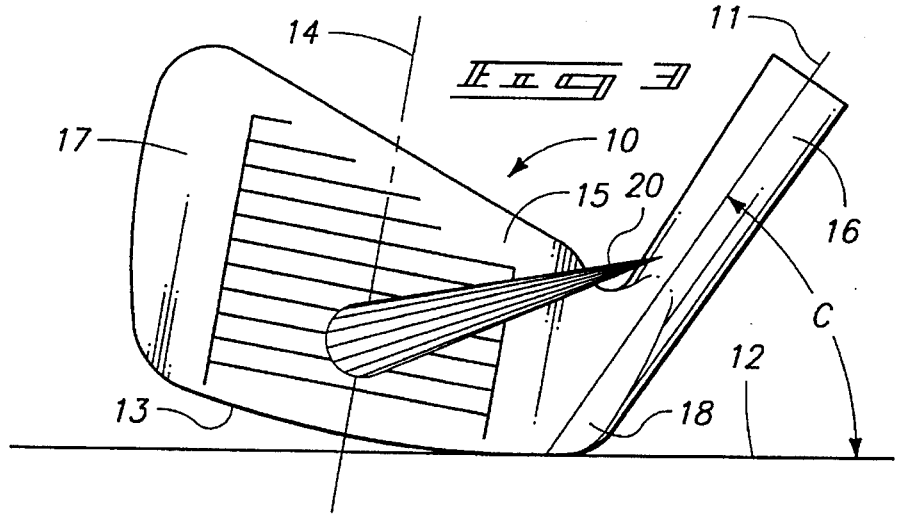
FIG. 3 is a diagrammatic view similar to FIG. 2 only showing the club heat tipped too upright and a cone on the club face indicating the resulting ball flight angle.

FIGS. 2 and 3 are included to show the effect of bad actual lie angles. FIG. 2 shows an actual lie angle B where the club head 10 is "too flat". Note the toe end 17 is tipped downwardly and the heel 18 elevated. A directional indicating cone 19 is drawn on the club face showing, in an exaggerated manner, the ball flight angle resulting if a ball is struck with the club head held too flat.

FIG. 3 shows an actual lie angle C in which the club head 10 is "too upright". Note here that the toe end 17 is elevated and the heel 18 is tipped downwardly. The resulting ball flight path is indicated by the directional cone 20.

Returning to FIG. 1, a cone 21 shown on the club face 15 is straight, indicating a straight ball flight angle. Thus it can be seen that the best "actual" lie angle is equal to the "true" lie angle for the club. The responsible teaching professional seeks to establish such match for each club fitted to a player.

Figure 6:
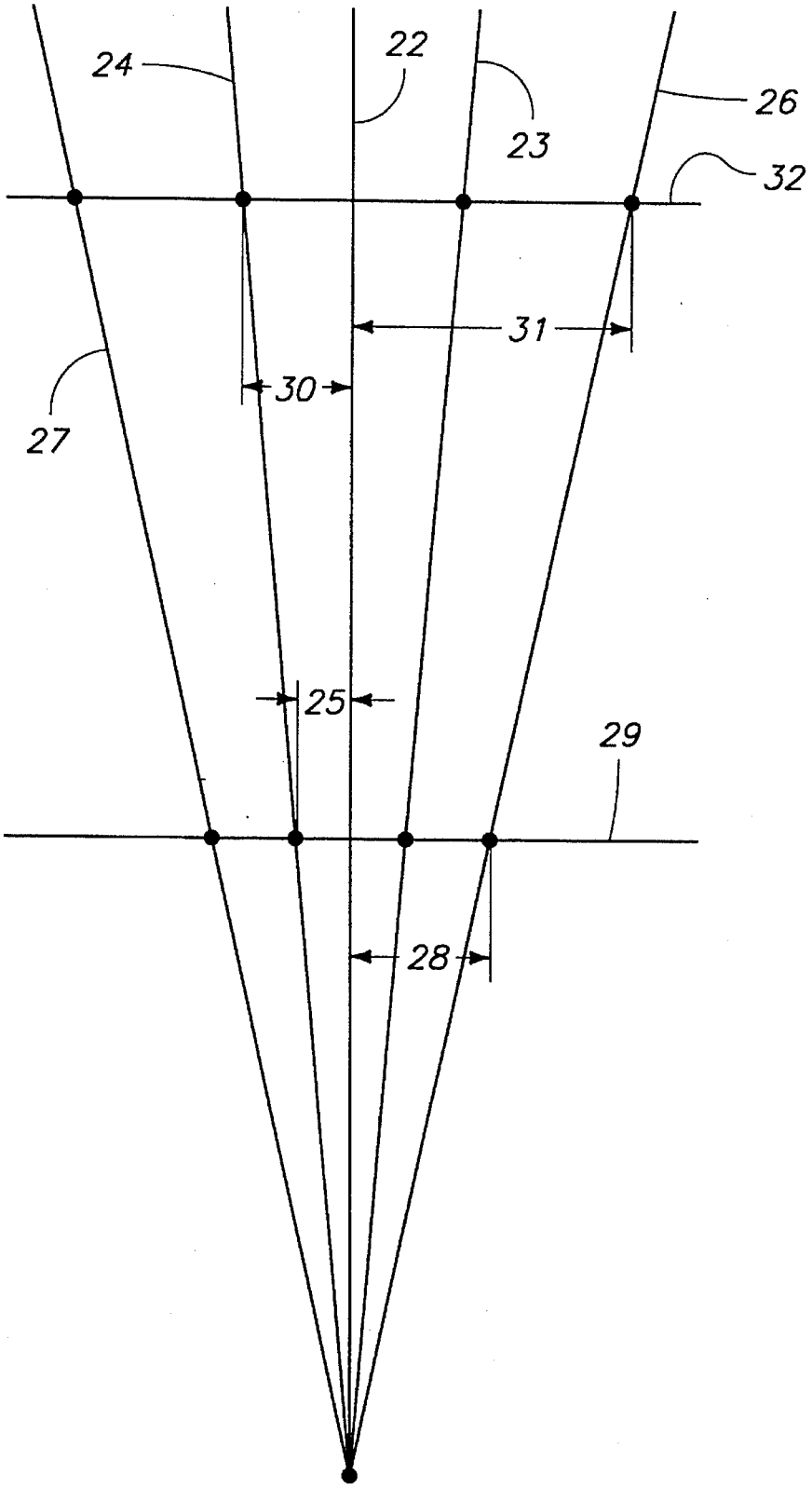
FIG. 6 is a schematic showing different ball flight angles in a comparison between a driver and a 9 iron held at different lie angles.
Figure 7:
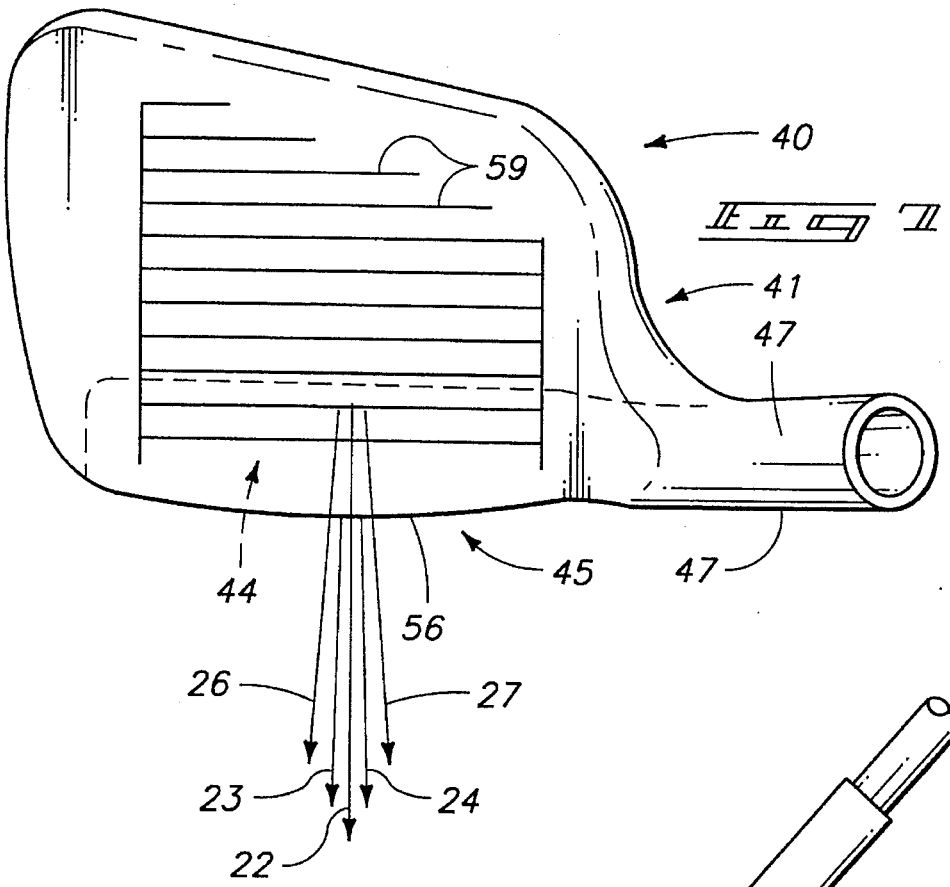
FIG. 7 is a top plan view of the presently preferred form of the demonstration device in which arrows indicate a proper ball flight angle and a comparison with improper ball flight angles resulting from the device being held at four degrees too upright.
Figure 8:
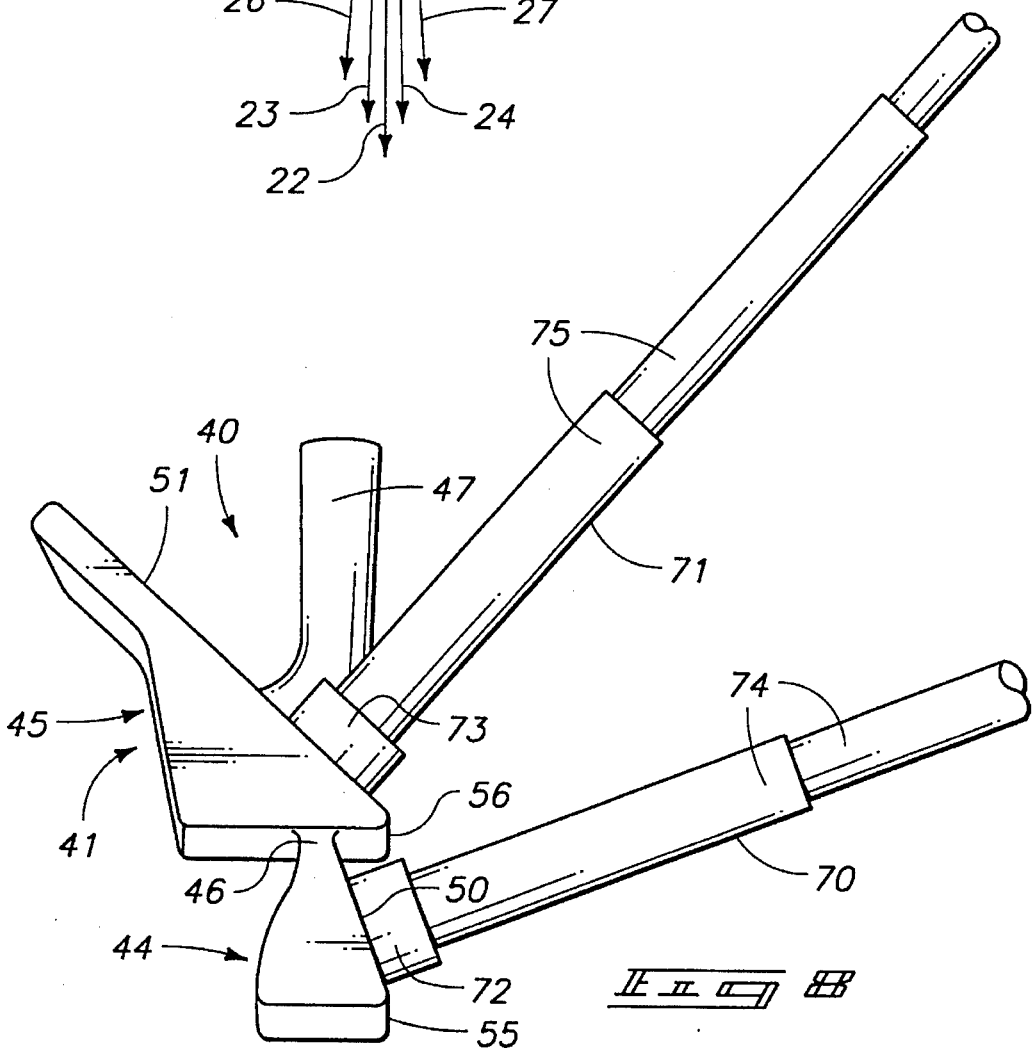
FIG. 8 is a toe end view of the presently preferred form of the demonstration held four degrees too upright and with magnetic ball flight angle indicators attached to the club faces.

FIG. 6 indicates graphically the effect bad lie angles have on ball flight path angles. To describe this, it is assumed that a golfer with a consistent swing first hits a ball with the club head at the true lie angle on impact. If a low loft club such as a driver is being used, the ball flight path 22 will be straight toward the target, say to a distance of 100 yards, as indicated by the line 29.

If the same club is used with the club head being too flat (say by 4 degrees) at impact, the resulting ball flight path 23 will angle to the right and the ball will land at a distance 25 approximately 7 feet to the right of the target. Conversely, if the club head at impact is too upright (4 degrees), the ball flight path 24 will angle to the left and the ball will land the same distance 25 (approximately 7 feet) to the left of the target.

It is a fact that ball flight path deviation will increase with club loft. Consider the same golfer using a 9 iron instead of a driver. At the 100 yard mark 29 with the club 4 degrees too flat, the ball flight path 26 will deviate further to the right than previously experienced with the driver. The ball will land a distance 28 approximately 22 feet to the right of the target. With the club face 4 degrees too upright, the ball flight path 27 will lead to the left and the ball will land the same distance 28, approximately 22 feet to the left of the target.

The above relations are shown at a 200 yard line 32, with distances 30 and 31 respectively being approximately 13 feet and 40 feet to the sides of the target.

A presently preferred form of demonstration device 40 is shown in FIGS. 5–8 to aid golf club fitting professionals to visually explain the importance of proper lie angle as demonstrated above to golfers being fitted for clubs. The device 40 will function to easily, quickly, and clearly show the differences in ball flight path due to different loft and actual lie angles without the teaching professional being required to explain the complexities involved in the compound angles of different loft club faces and their effect on ball flight path.

In a preferred form, the present device includes a rigid body 41 extending between heel and toe ends 42, and 43. The preferred rigid body is comprised of first 44 and second 45 simulated or actual club heads. The club heads 44, 45 may be formed of any reasonably rigid material, such as the same material used for construction of golf club irons (usually cast or forged steel).

In preferred forms, the club heads 44, 45 are stacked, one on the other. Means 46 is provided between the club heads 44, 45 for rigidly securing the club heads in stacked relation.

In a first preferred form, said means 46 is comprised of a weld joining the first and second golf club heads 44, 45 rigidly together. Equivalent means might include appropriate fasteners such as bolts, rivets, screws, dowel pins, adhesives, brazing, soldering, or other known fasteners or attachments for securing the two club heads together.

In one preferred form, a hosel 47 is provided at the heel end of at least one of club heads 44, 45. As shown, each of the club heads 44, 45 includes a hosel. Alternatively, the heads could be provided without hosels. However, to promote visual similarity to standard club heads, it is preferred that at least one of the heads include a hosel. The hosel 47 also allows for connection to a standard shaft (not shown).

A first club face 50 is provided on the rigid body 41, preferably on the first club head 44, set on a plane at a first loft angle. A second club face 51, preferably on the second club head 45 is provided on the rigid body 41 on a plane set at a second loft angle. The two loft angles are clearly distinguishable in FIG. 4. Advantageously the second loft angle is greater than the first loft angle.

The first loft angle exemplified in the drawings is similar to that of a 2 iron, while the second loft angle is similar to that of a 9 iron. Other loft angles could be used, as long as there is a substantial angular difference between the two.

The first and second club faces 50, 51 preferably include respective first and second sole surfaces 53, 54 that extend between the respective heel and toe ends 42, 43. The soles overlap one another, terminating at leading edges 55, 56. The leading edges 55, 56 are substantially parallel and vertically aligned as shown by FIG. 4.

The first and second club faces advantageously include grooves 58, 59 extending between the heel and toe ends 42, 43. The grooves 58 of the first club face 50 are substantially parallel to the grooves 59 of the second club face 51.

Figure 4:
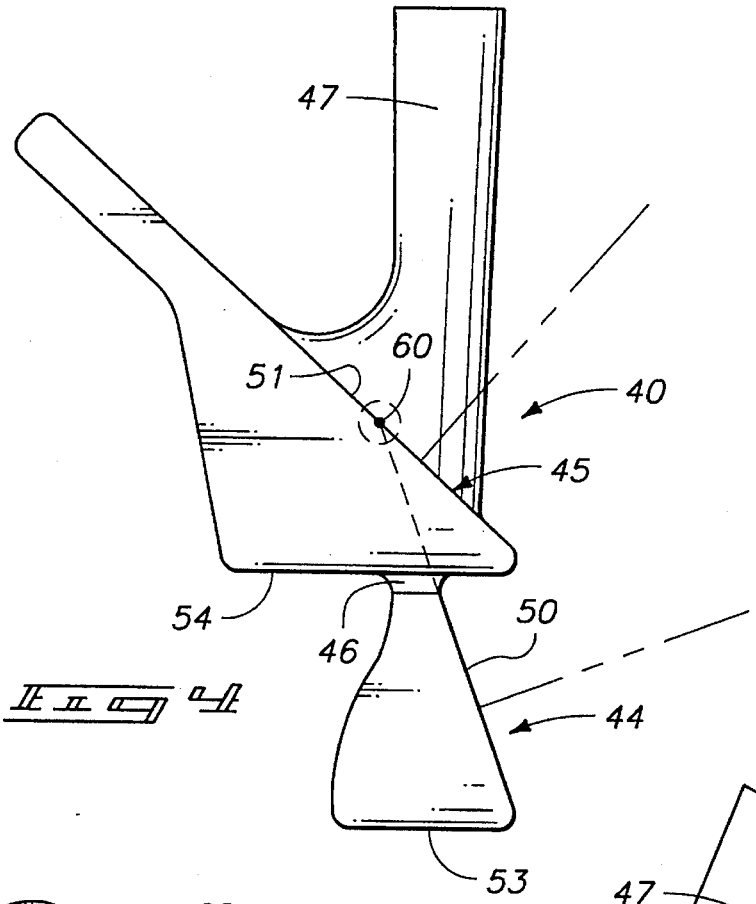
FIG. 4 is an end view, looking from the toe to the heel of the club heads in a preferred form of the present demonstration device.
Figure 5:
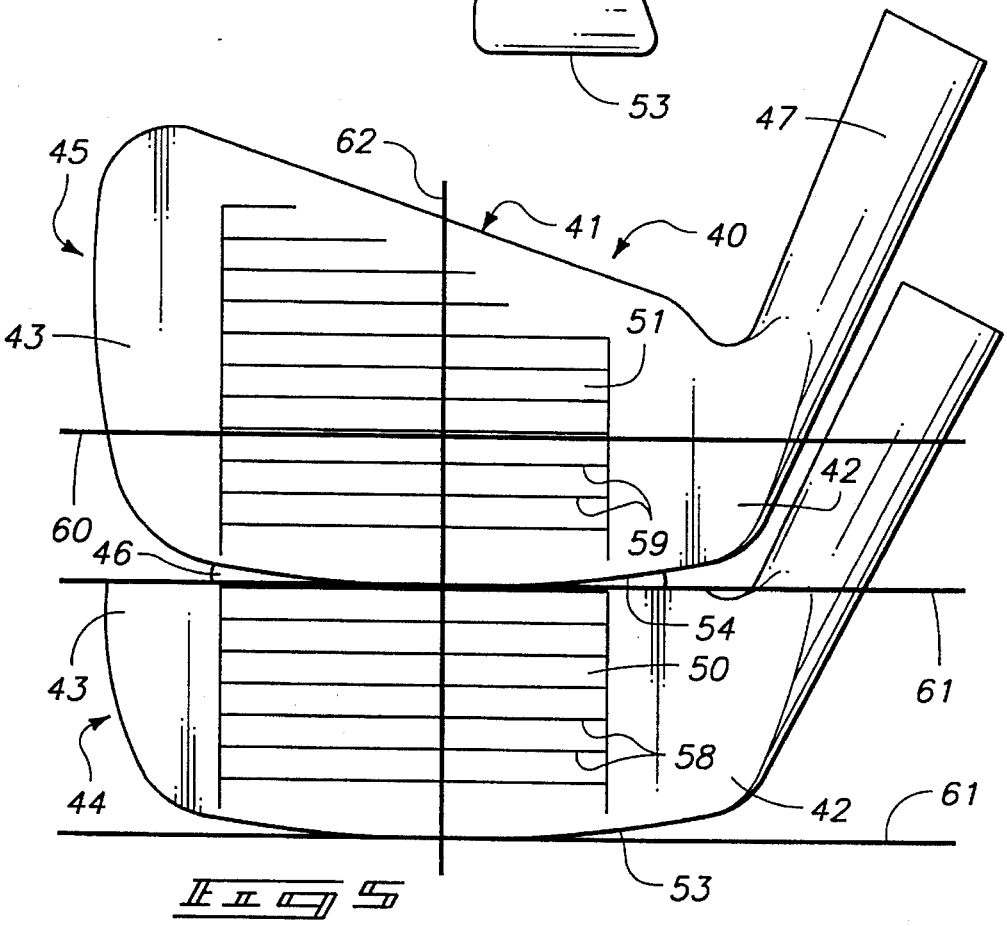
FIG. 5 is a frontal view of the presently preferred form, as seen from the right in FIG. 4.

The club faces 50, 51 are oriented in relation to one another such that the planes of the first and second faces intersect along a reference line 60 (FIGS. 4 and 5). This line 60 is substantially parallel to either of two parallel sole reference lines 61 (FIG. 5) that in turn are tangent to the soles 53 or 54 at a reference face centerline 62. Preferably the first and second club faces include substantially coextensive or aligned reference face centerlines 62, which by such alignment show as a single line in FIG. 5.

Both club faces are secure in the same relative angular orientations regardless of the position of the device with respect to the ground surface. And with reference lines 60 and 61 parallel, and centerlines 62 aligned, the club faces are secured together in equivalent true lie angles. Thus the actual lie angles will be equivalent for any angle through which the club faces are moved. This allows for a clear, precise and instant indication of the ball path angle for both club faces for any angular relation of the faces to the ball or ground surface.

For example, first and second a magnetic directional indicators 70, 71 (FIG. 8) may be attached to the respective first and second club faces. The indicators 70, 71 include magnets 72, 73 with flat club face engaging surfaces and perpendicular, telescoping rods 74, 75. The rods will indicate ball flight path when the magnets are attached to the club faces. By comparing the two rods at any given actual lie angle of the club faces, the observer can visually detect the differences in ball flight paths.

Examples of differences are graphically indicated by the lines 22, 23, 24, 26, and 27 (which may be correlate to similarly numbered lines in FIG. 6). Line 22 represents the ball flight path when both club faces are at their true lie angles. Lines 24 and 27 represent the ball flight paths from the first and second club faces 50, 51 when the actual lie angle is 4 degrees too upright. This divergence would be clearly shown by the magnetic indicators. Similarly, lines 23, 26 represent the ball flight paths from the first and second club faces 50, 51 when the actual lie angle is 4 degrees too flat.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A golf ball flight angle demonstration device, comprising:

a rigid body having first and second club faces with different lofts and which are oriented in predetermined spaced, stacked relation, one to the other, the first club face having a given lie angle, and wherein the second club face has a lie angle which is substantially similar to the lie angle of the first club face, and wherein each club face has a hosel.

2. A golf ball flight angle demonstration device as claimed in claim 1, wherein each face is oriented in the same direction.

3. A golf ball flight angle demonstration device as claimed in claim 1, and wherein each hosel lies in substantially the same plane.

4. A golf ball flight angle demonstration device as claimed in claim 1, and wherein each face has a reference face centerline, and wherein each reference face centerline lies in substantially the same plane.

5. A golf ball flight angle demonstration device as claimed in claim 1, and wherein each club face has a sole surface, and wherein each club face has a reference line which is tangential to the sole of each club face, and perpendicular to the respective reference face centerlines, and wherein the individual reference lines are substantially parallel to each other.

6. A golf ball flight angle demonstration device, comprising:

a rigid body having first and second golf club heads which are affixed together in predetermined spaced stacked relation one to the other, each golf club head having a given different loft, and the club faces simultaneously oriented in the same direction, and wherein the respective first and second club faces have substantially similar lie angles, and a hosel is borne on one of the golf club heads.

7. A golf ball flight angle demonstration device as claimed in claim 6, wherein a hosel is borne on each golf club head.

8. A golf ball angle demonstration device as claimed in claim 7, and wherein each hosel lies in substantially in the same plane.

9. A golf ball flight angle demonstration device as claimed in claim 6, and wherein each club face has a reference face centerline, and wherein each reference face centerline lies in substantially the same plane.

10. A golf ball flight angle demonstration device as claimed in claim 9, wherein each club face has a sole surface, and wherein each club face has a reference line which is tangential to the sole of each club face, and perpendicular to the respective reference face centerlines, and wherein the individual reference lines are substantially parallel to each other.

11. A golf ball flight angle demonstration device, comprising:

a first golf club head having a face, a sole, a given loft, and lie angle, a hosel and a reference face centerline; and a second golf club head made integral with the first golf club head, the second golf club head positioned in predetermined spaced relation relative to the first golf club head, and wherein the second golf club head has a face, a sole, and a reference face centerline, the face of the second golf club facing substantially in the same direction as the face of the first golf club head, and wherein the second golf club head has a loft which is different from the loft of the first golf club head, and wherein the reference face centerline of each of the golf club heads lie in substantially the same plane, and wherein each golf club head has a reference line which is tangential to the sole of each of the golf club heads, and perpendicular to the respective reference face centerlines, the individual reference lines being substantially parallel to each other.

* * * * *